US005476300A

United States Patent [19]

Dodge

[11] Patent Number: 5,476,300

[45] Date of Patent: Dec. 19, 1995

[54] ADJUSTABLE LIFTING DEVICE FOR SEWER FRAME OR THE LIKE

[76] Inventor: John P. Dodge, 1507 Brixham Ave., McHenry, Ill. 60050

[21] Appl. No.: 198,122

[22] Filed: Feb. 17, 1994

Related U.S. Application Data

[63] Continuation-in-part of Ser. No. 50,842, Apr. 21, 1993, Pat. No. 5,306,062.

[51] Int. Cl.[6] ..... B66C 1/14; B66C 1/66

[52] U.S. Cl. ..... 294/81.21; 294/67.33; 294/81.6; 294/90; 294/93

[58] Field of Search ..... 294/67.1, 67.3, 294/67.33, 81.1–81.21, 81.5, 81.54, 81.56, 81.6–81.62, 90, 93–97, 902

[56] References Cited

U.S. PATENT DOCUMENTS

| | | | |
|---|---|---|---|
| 168,707 | 10/1875 | Beach et al. | 294/67.1 |
| 1,774,623 | 9/1930 | Williams | 294/81.6 |
| 2,757,036 | 7/1956 | Smith | 294/67.1 |
| 2,923,569 | 2/1960 | Milliron | 294/97 |
| 3,206,243 | 9/1965 | Miles | 294/93 X |
| 3,339,966 | 9/1967 | Carlson | 294/90 X |
| 3,401,973 | 9/1968 | Marshall | 294/93 |
| 3,442,546 | 5/1969 | Bachman | 294/67.3 |
| 4,136,903 | 1/1979 | Roethler | 294/97 X |

FOREIGN PATENT DOCUMENTS

| | | | |
|---|---|---|---|
| 1337489 | 8/1963 | France | 294/93 |
| 441389 | 2/1992 | Japan | 294/93 |
| 1393764 | 5/1988 | U.S.S.R. | 294/93 |
| 1638097 | 3/1991 | U.S.S.R. | 294/81.21 |

*Primary Examiner*—Johnny D. Cherry
*Attorney, Agent, or Firm*—Mathew R. P. Perrone, Jr.

[57] ABSTRACT

An adjustable lifting device, which includes a lifting frame, with at least one adjustable arm thereon and a lifting arm secured thereto is buttressed by sleeves and bars connecting each adjustable arm to the lifting arm.

6 Claims, 8 Drawing Sheets

FIG. 2
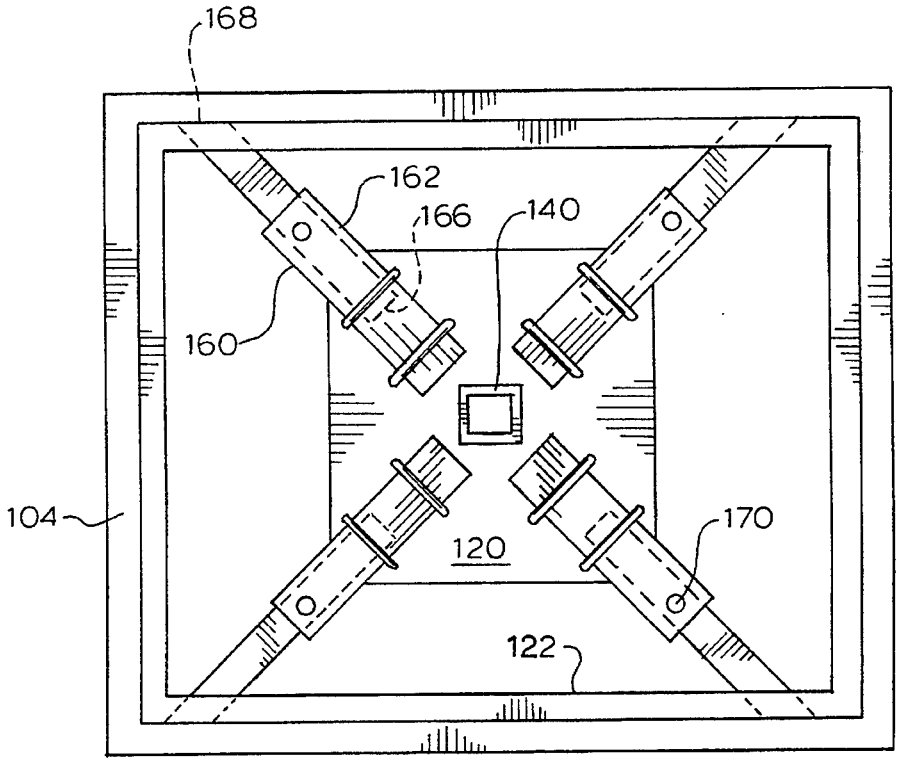
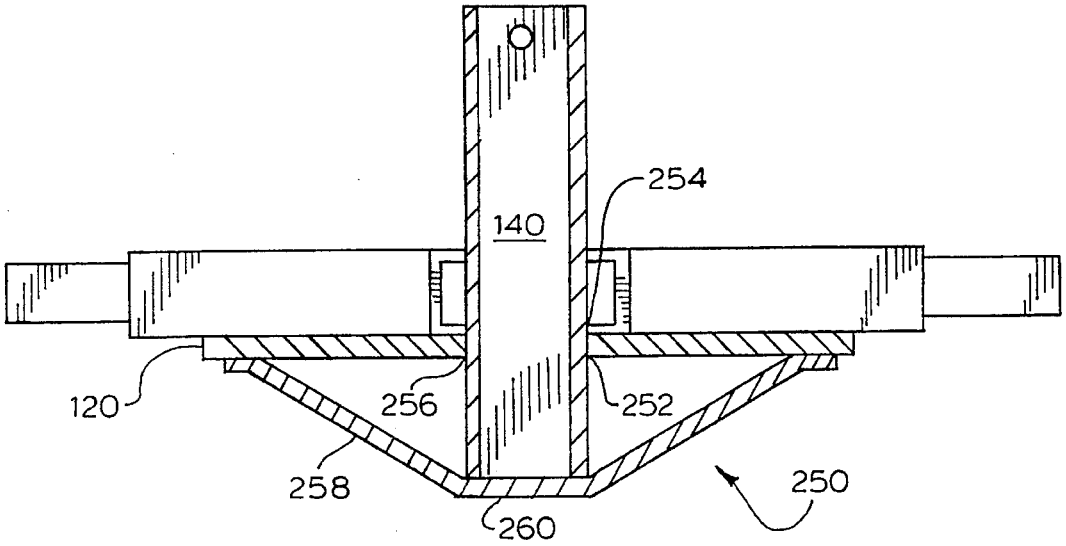
FIG. 3

FIG. 4
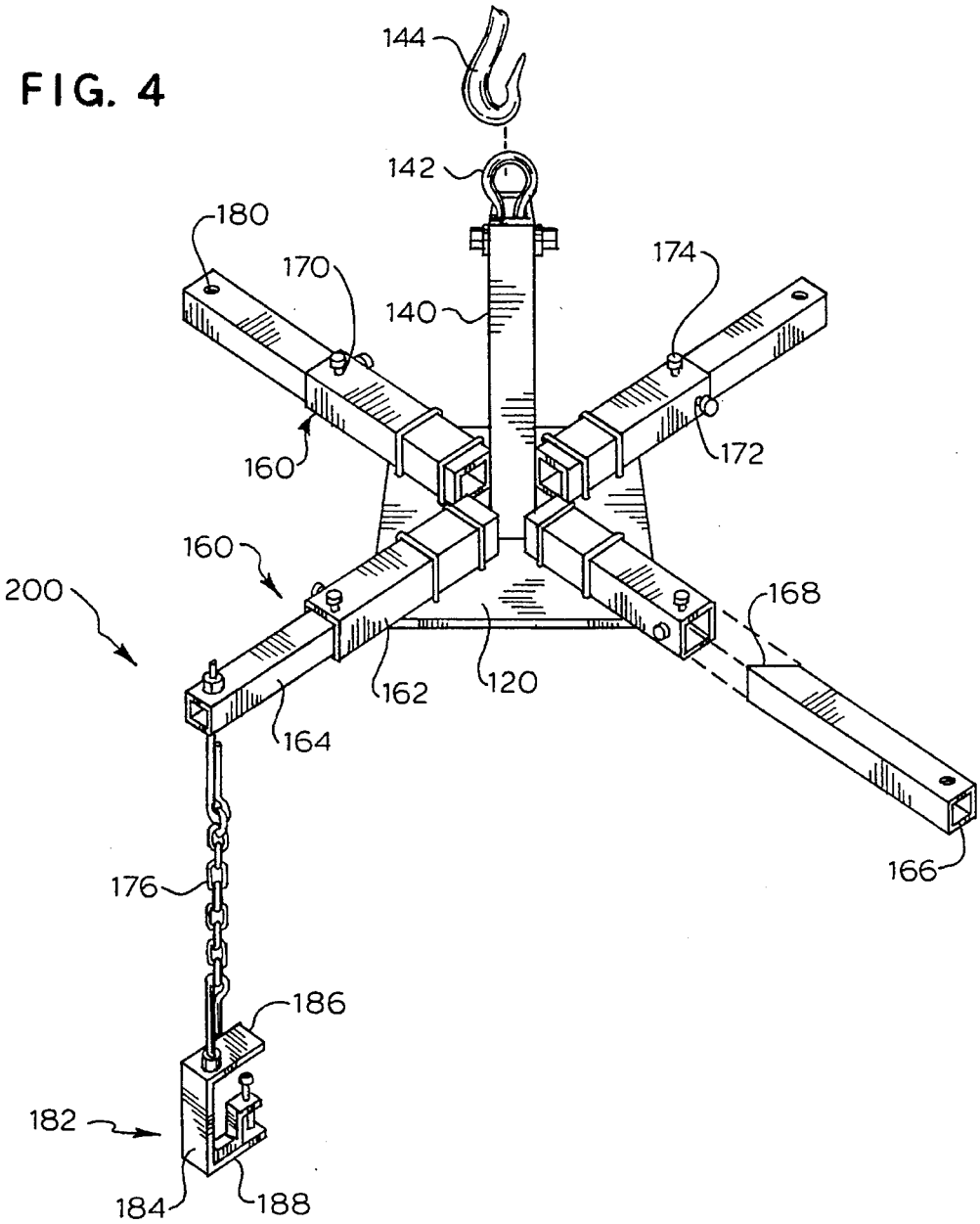
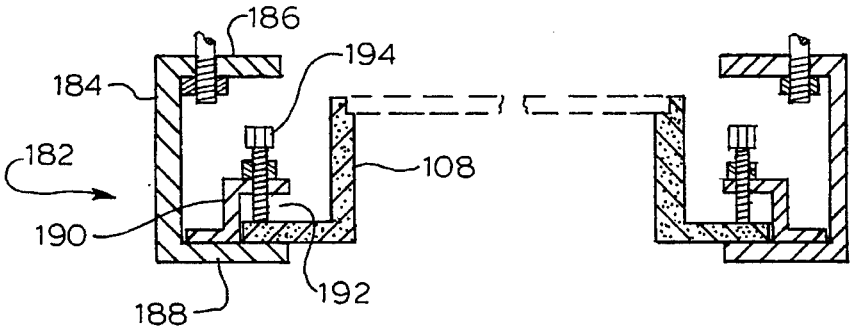
FIG. 5

ADJUSTABLE LIFTING DEVICE FOR SEWER FRAME OR THE LIKE

CROSS-REFERENCE TO RELATED APPLICATION

This application is a continuation-in-part of U.S. patent application Ser. No. 08/050,842 filed Apr. 21, 1993, by the same inventor. This application now stands issued as U.S. Pat. No. 5,306,062.

This invention relates to a lifting device, and more specifically to an adjustable lifting device for lifting into place a manhole, a frame, a storm frame, a sewer frame (with or without an inner lip) or any round, square or rectangular object.

BACKGROUND OF THE INVENTION

In construction work, many heavy items must be lifted, moved, and placed in a proper position. These items have in common both great weight and bulkiness. Sewer construction materials form a prominent number of these items. Clearly such items are difficult to handle efficiently and safely.

A manhole frame and a storm frame are typical of the heavy pieces of metal that must be placed in order to complete a sewer project. The extreme weight and bulkiness of such an element make that element very difficult to place appropriately. Traditionally, at least two, if not four and usually more, laborers are required to lift that element into place.

There is no good way to lift that device with a machine. There is no good way to get a handle on it with the machine. Thus, the construction crew is left with the necessity of physically moving the device into position.

These elements also come in many different shapes and sizes. It is desirable to be able to lift each of them with one simple device that is adaptable to a wide range of construction equipment that is found on the job. Such an adaptable, lifting device is not available. A device of this type can be very useful. If such a lifting device is developed, it can also be used for lifting a wide variety of other heavy elements.

With regard to a sewer frame or a manhole frame, it is difficult to put a sufficiently strong lifting mechanism on the frame itself. The lifting mechanisms must be strong yet, while still avoiding interference with the construction process. It must also not interfere with the making of the frame itself. Accordingly, the idea of attaching a lifting mechanism directly to the frame is not a good solution to the problem.

SUMMARY OF THE INVENTION

Among the many objectives of this invention is the provision of an adjustable lifting device to assist in a construction project, requiring the movement and placement of a heavy element.

A further objective of this invention is to provide an adjustable lifting device to assist in the placing of a sewer frame or a storm frame.

A still further objective of this invention is to provide an adjustable lifting device to adjust to the size of a sewer frame or a storm frame.

Yet a further objective of this invention is to provide an adjustable lifting device to adjust to the shape of a sewer or a storm frame.

Also an objective of this invention is to provide an adjustable lifting device for lifting a heavy item with a machine.

Another objective of this invention is to provide an adjustable lifting device for placing a heavy item with a machine.

Yet another objective of this invention is to provide an adjustable lifting device for moving a heavy item with a machine.

Still another objective of this invention is to provide a method for placing of a sewer frame or a storm frame.

These and other objectives of the invention (which other objectives, become clear by consideration of the specification, claims and drawings as a whole) are met by providing an adjustable lifting device, which includes a lifting frame, with at least one adjustable arm thereon and a lifting arm secured thereto.

BRIEF DESCRIPTION OF THE DRAWINGS

FIG. 2 depicts a top plan view of the adjustable lifting device 100 of this invention, as applied to square sewer frame 104.

FIG. 3 depicts a side, partially cross-sectional view of the heavy duty lifting device 250 showing adjustable lifting arm 120.

FIG. 4 depicts a top perspective view of the chain lifting device 200 of this invention.

FIG. 5 depicts a side, partially cross-sectional view of the chain lifting device 200 of this invention, applied to a lipless sewer frame 108.

Throughout the figures of the drawings, where the same part appears in more than one figure of the drawings, the same number is applied thereto.

DESCRIPTION OF THE PREFERRED EMBODIMENTS

Figure 1:
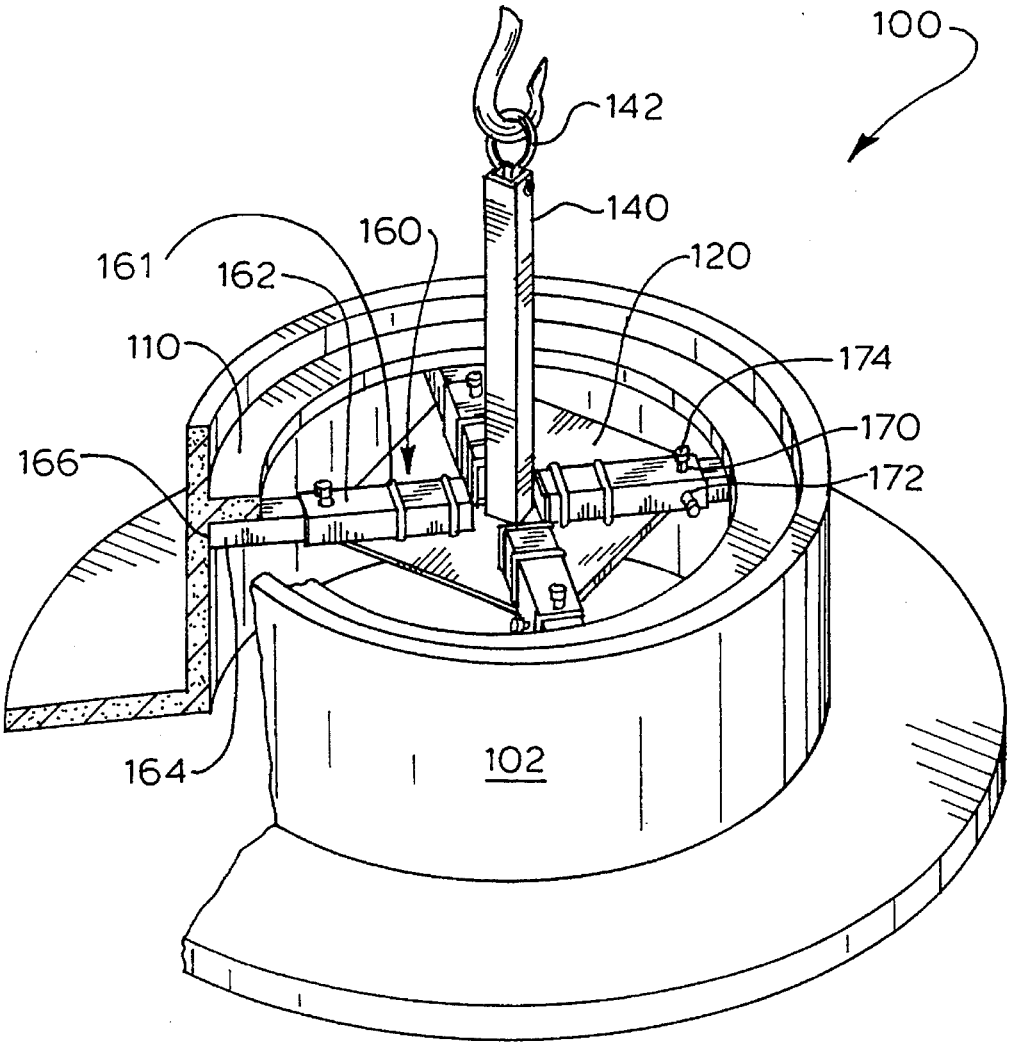
FIG. 1 depicts a top perspective view of the adjustable lifting device 100 of this invention, as applied to round sewer frame 102.

The lifting device of this invention includes a frame. Mounted on the frame is a lifting arm. The lifting arm is attachable to any power implement such as a backhoe or other similar device. Extending from the frame are a plurality of arms radially spaced around the frame. The frame is generally a flat platform having the lifting device mounted thereon. The radial arms include a fixed member mounted to the frame and a slidable member mounted therein. The slidable member can be extended beyond the frame and fit into the inner lip of a manhole frame. The slidable or radial arm can be fixed in place by bolting or other suitable devices and locked under the lip of the manhole frame. In this fashion, the backhoe or other suitable machine (not shown) can be attached to the lifting arm and lift the manhole frame or similar item, so that it may be transferred to the appropriate place.

Clearly, the purpose of this device is to lift and set into place a manhole cover, a storm frame, a sewer frame; or any round, square, or rectangular heavy object. The lifting device of this invention is designed to lift the object from either the inside of the frame if there is an inside lip or from the outside of the frame by using a formed clamping device with a setting bolt or other clamping mechanism.

The slidable arms can be replaceable. This replacement can compensate for the different shapes of the manhole cover such as the square manhole or the round manhole frame as desired, by providing an appropriately shaped arm. When the slidable arm wears out, it may be simply replaced.

Additionally, the slidable arms can have different shapes on either end thereof. This factor can compensate for the different shapes of the frame being installed, such as the square manhole or the round manhole frame as desired.

The arms are adjustable to fit different sized objects. The arms lock into place by setting bolts or other suitable means. When lifting from the outside of an object, the formed clamps are attached to chains or other flexible devices and the chains are attached to the adjustable arms.

On the occasion when there is no inner lip in the manhole frame, a chain mechanism or other suitable flexible device may be secured to the end of each arm. At the other end of the chain is a clamp which may by clamped onto the outer lip of the frame. By clamping the outer lip of the frame within the clamp device and lifting the clamp with the chain and the similar frames, great advantages are obtained in lifting even the manhole frames without the inside lip.

It is also possible for a very heavy duty concept of the lifting device to extend the lifting arm down through the frame. The frame can then by buttressed thereby securing the lifting arm again to the frame and strengthening the device over all. In this fashion, greater weights can be lifted by the device of this invention.

The lifting frame is additionally buttressed on the lifting arm. The lifting arm may have an aperture therein. A C-shaped member may slide thereover and have corresponding apertures so that the lifting arm may be pinned therein by a cotter pin and bar arrangement. The lifting mechanism from the C-shaped member comes from an O-ring bolted into the top of the C-shaped member.

It is feasible to further strengthen the lifting capability by additionally supporting the arms of the lifting device. This is accomplished by providing sleeves for each adjustable arm and another sleeve for the lifting arm. These sleeves fit thereover and are connected by bolted metal bars. The sleeves have an upward protrusion including an aperture for bolting the bars thereto. In this fashion, the lifting frame is greatly strengthened. While it is not desired to be bound by any particular theory, it is believed that the bars do not stretch as much as the chains do, thereby providing the greater strength.

In order to simplify the attaching of chains and clamps for outside lifting devices, it is possible to provide in the lifting arms one or more apertures. Into these apertures are bolted three elongated eye rings. The eye rings may receive therein a clip chain member. The other end of the chain also has a clip member for attaching to eye rings of clamps to be attached to the frame.

These clamps are themselves C-shaped. The clamps include an outer C-housing, a support bar, and an aperture in the upper support bar to receive a bolted O-ring member. Outside the support bar is a clamping mechanism in threaded relation therewith for clamping the lower part of the C-bar to the outside frame. This structure provides a very simple strong support for the outside frame.

As shown in FIG. 1, clearly the purpose of this lifting device 100 is to lift and set into place a round sewer frame 102 or any similar item such as a manhole cover, a storm frame; or any round, square or rectangular heavy object. The lifting device 100 of this invention is designed to lift the object from either the inside of the sewer frame 102 if there is an inside lip or from the outside of the sewer frame 102 by using a formed clamping device with a setting bolt or other clamping mechanism.

The lifting device 100 of this invention includes a lifting frame 120. Mounted on the lifting frame 120 is a lifting arm 140. The lifting arm 140 is attachable to any power implement such as a backhoe (not shown) or other similar device. Extending from the lifting frame 120 are a plurality of arms 160 radially spaced around the lifting frame 120. The lifting frame 120 is generally a flat platform having the lifting arm 140 and at least two of radial arms 160 mounted thereon.

To form the radial arm 160, a fixed member 162 is mounted to the lifting frame 120 with U-bolts 161, welds or a similar method, and a slidable member 164 mounted slidably and fixably in fixed member 162. The slidable member 164 can be extended beyond the lifting frame 120 and fit into the inner lip of a sewer frame 102. The slidable member 164 is secured in the fixed member 162 by lock bolt 174 or other suitable devices.

The slidable member 164 is extended sufficiently so that all slidable members 164 can be locked under the lip 110 of the sewer frame 102. In this fashion, the backhoe or other suitable machine (not shown) can be attached to the lifting arm 140 and lift the sewer frame 102 or similar item, so that it may be transferred to the appropriate place.

The slidable arms 160 can be replaceable. This replacement can compensate for the different shapes of the manhole cover such as the square manhole or the round sewer frame 102 as desired, by providing an appropriately shaped arm. When the slidable arm 160 wears out, the slidable member 164 may be simply replaced.

Additionally, the slidable arms 160 can have different shapes on either end thereof. This factor can compensate for the different shapes of the heavy frame being installed, such as the square sewer frame 104 of FIG. 2 or the round sewer frame 102 of FIG. 1 as desired.

Because the arms 160 are adjustable to fit different sized objects, the arms 160 lock into place by setting bolts or other suitable means. When lifting from the outside of an object, the formed clamps are attached to chains or other flexible devices and the chains are attached to the adjustable arms.

The frame 120 of this device 100 can be a flat piece of sheet metal having a suitable thickness for the desired strength. Preferably, this sheet metal has a thickness of up to 2 centimeters. More preferably, the thickness of the frame 120 is from about one-tenth of a centimeter to 1.5 centimeters. Most preferably, the thickness is about 0.2 of a centimeter to 1 centimeter.

The referenced thicknesses assume that the weight being lifted is about 200 to 300 kilograms. If the weight increases or decreases, the thickness of the frame 120 can be adjusted for additional strength. Similar adjustments can be made in other elements of the device 100. This flat piece of metal or frame 120 is of any suitable shape.

Secured to the frame 120 is the lifting arm 140. The lifting arm 140 is generally centrally located in the frame 120. The lifting arm 140 is secured to the surface of the frame 120 by welding, bolting or another suitable mechanism. The lifting arm 140 has at the other end a lifting ring 142 suitable for receiving a hook 144 attached to a lifting chain (not shown) or other lifting device attached to a backhoe (not shown) or similar instrument. As the hook 144 is looped through the lifting ring 142, the lifting arm 140 can lift the frame 120. The lifting arm 140 may also be bolted or otherwise secured to the frame 120.

Each slidable arm 160 includes a fixed member 162 tubular in nature and secured to the frame 120. Within the fixed member 162 is a slidable tubular member 164 slidably mounted therein. The slidable tubular member 164 has the great capability of sliding in and out of the fixed member 162 so that the length of the slidable arms 160 may be adjusted. In this fashion, the slidable arms 160 are adjusted to fit into the storm frame or the sewer frame.

Figure 11:
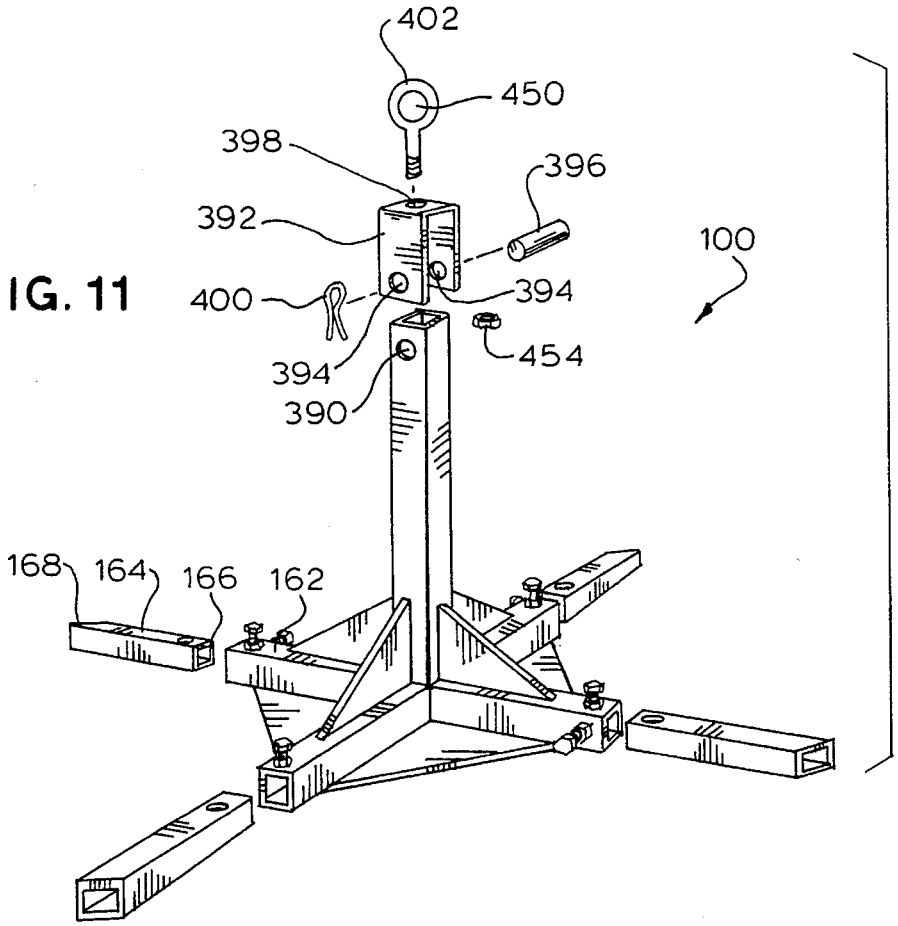
FIG. 11 depicts a top, perspective, exploded view of the lifting device 100 of this invention.
Figure 12:
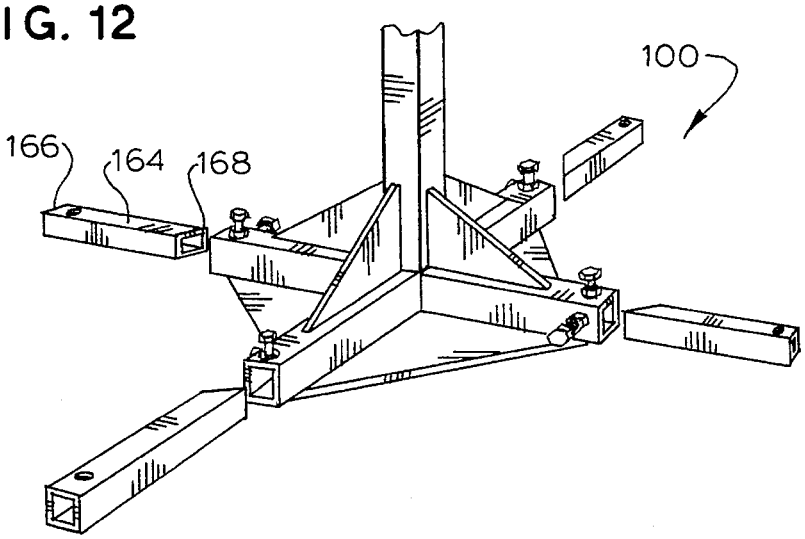
FIG. 12 depicts a partial, top, perspective, exploded view of the lifting device 100 of this invention.

FIG. 2, FIG. 11 and FIG. 12 combine with FIG. 1 to show that first end 166 of the slidable member 164 is shaped in any suitable fashion, The first end 166 is shaped preferably as a rectangle. This with three other radial arms 160 comprise the lifting mechanism for the interior frame lip 122 of a storm frame.

The second end 168 of the slidable member 164 may be an angled end 168 suitable for lifting of a square storm frame 104. Each second end 168 can fit inside the lip 122 of a storm frame or sewer frame and attach thereto.

Fixed member 162 has a plurality of fixed member apertures 170 which line up with each slidable member 164 and receive lock bolts 174 thereon for the purpose of locking the radial arms 160 in the proper position. This adjustment permits easy adjusting of the radial arm 160. The lock bolt 174, combined with the apertures 170 and 172, may also be replaced by a pawl and rachet assembly which can position the radial arms 160 within the storm frame 120 also.

FIG. 3 depicts one form of heavy duty lifting device 250. If it is desired to more firmly attach the lifting arm 140 to the frame 120, the frame 120 can have frame aperture 252 and the lifting arm 140 mounted therethrough. The lifting arm 140 is then welded in two areas on the upper part 254 and lower part 256 of the frame 120 to the lifting arm 140. A subsequent support bar 258 can be put across the base 260 of the lifting arm 140 and secured to the frame 120 to further strengthen the lifting mechanism of the frame 120 and the lifting arm 140. In this fashion, a very durable device can be made for lifting much heavier objects.

By considering FIG. 4 and FIG. 5, it is possible to have an end aperture 180 in slidable member 164 and form chain lift 200. This end aperture 180 can receive a chain or similar mechanism. Upon receiving a lifting chain 176, a clamp 182 can be secured to the opposing end of lifting chain 176. Chain 176 may also be secured to arm 160 in any other suitable fashion.

This clamp 182 includes a C-member 184 having a top portion 186 of the C-member 184 secured to the chain and a bottom portion 188 of the C-member 184 having a second bar 190 thereby forming a gap 192 with the bottom portion 188 of the C-member 184.

A frame bolt 194 is mounted in the second bar 190 and is rotated downwardly when the edge of a storm frame 120 is inserted therebetween. With the plurality of three other arms 160 and chains 176, the frame 120 may be lifted into position. This assumes for the sake of argument that the item being lifted is lipless sewer frame 108, which has no lip inside to use the other embodiments.

On the occasion when there is no inner lip in the sewer frame 102, a chain mechanism or other suitable flexible device may be secured to the end of each arm. At the other end of the chain is a clamp which may be clamped onto the outer lip of the lifting frame 120. By clamping the outer lip of the lifting frame 120 within the clamp 182 and lifting the clamp 182 with the chain 176 and the similar lifting frame 120, great advantages are obtained in lifting even the manhole lifting frames without the lip.

It is also possible for a very heavy duty concept of the lifting device 100 to extend the lifting arm 140 down through the lifting frame 120. The lifting frame 120 can then be buttressed thereby securing the lifting arm 140 again to the lifting frame 120 and strengthening the device 100 over all. In this fashion, greater weights can be achieved.

Figure 6:
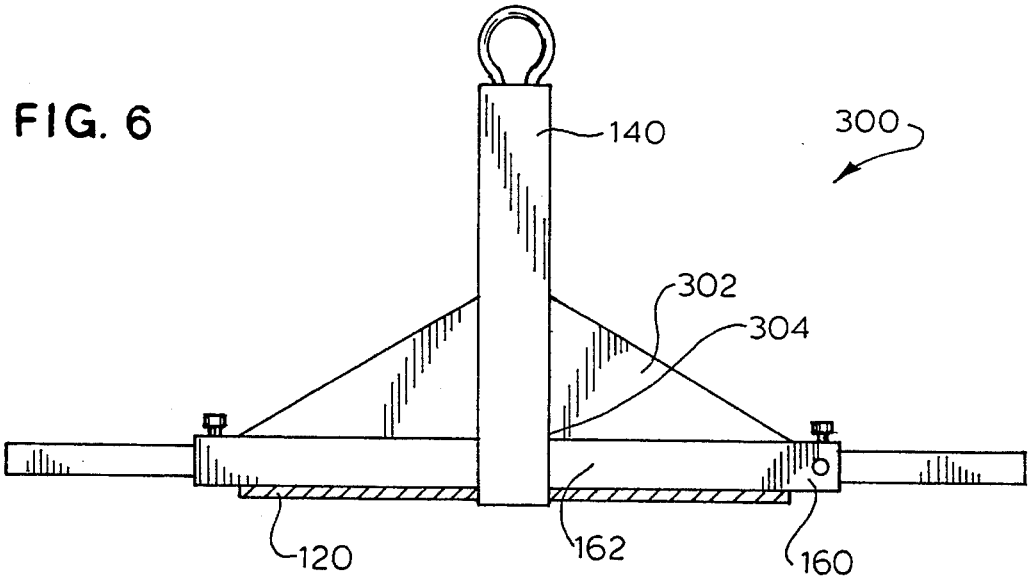
FIG. 6 depicts a side, partially cross-sectional view of the reinforced lifting device 300 showing buttress 302.

Because of the generically heavy items designed to be moved by a device of this invention, FIG. 6 depicts a highly preferred device within the scope of this invention. The reinforced lifting device 300 has in addition up to four of a buttress 302. Customarily, there is one buttress 302 for each arm 160.

The reinforced lifting device 300 has much of the standard structure of the other devices. Common is the lifting frame 120 and the lifting arm 140. However, a buttress 302 supports lifting arm 140 in relation to the fixed member 162. Buttress 302 is preferably a right triangle flat piece of metal having a right angle at the juncture 304 of lifting arm 140 and fixed member 162. By welding or otherwise securing buttress 302 on each fixed member 162 and lifting arm 140, great strength is added when reinforced lifting device 300 is compared to lifting device 100.

Figure 7:
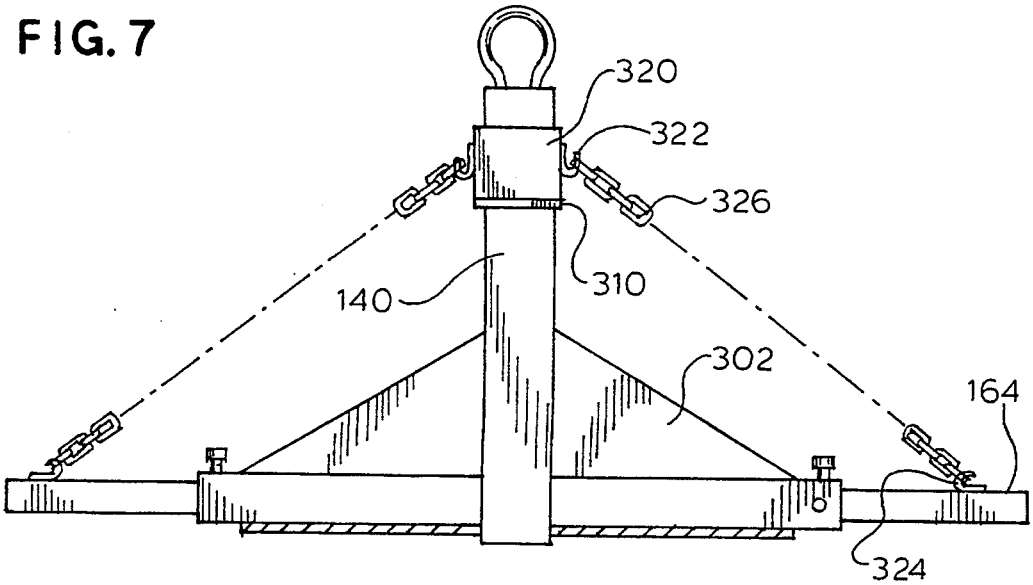
FIG. 7 depicts a side, partially cross-sectional view of the reinforced lifting device 300 showing collar hook 322.

FIG. 7 depicts a modification of FIG. 6 with the addition of stop member 310, lifting collar 320 and collar hook 322. Lifting arm 140 is modified by having a stop member 310 welded or otherwise secured thereon. The stop member 310 is mounted slightly above the buttress 302. With stop member 310, the lifting collar 320 is slidably mounted over lifting arm 140 and spaced from buttress 302 by stop 310.

On lifting collar 320 is a collar hook 322. Collar hook 322 works together with movable arm hook 324 to receive support chain 326. Collar hook 322 and movable arm hook 324 are connected by a support chain 326, extending therebetween and slidably mounted thereover. With four support chains 326 in position on each of four pairs of collar hook 322 and movable arm hook 324, slidable member 164 is supported very strongly for greatly extended arms and heavier weights.

Figure 8:
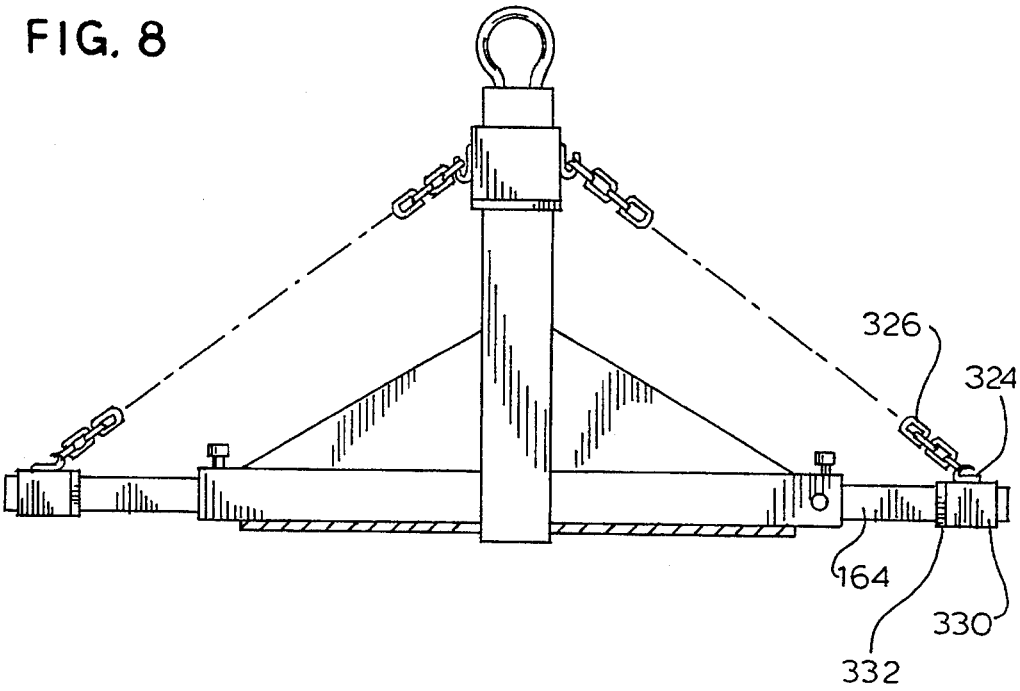
FIG. 8 depicts a side, partially cross-sectional view of the reinforced lifting device 300 showing collar hook 322 and movable arm hook 324.

While movable arm hook 324 may be welded or otherwise secured to slidable member 164, it is possible to provide arm sleeve 330 with movable arm hook 324 welded or otherwise secured thereto as shown in FIG. 8. Arm stop 332 is welded or otherwise secured to slidable member 164 to restrict inward movement of arm sleeve 330. Support chain 326 can then also be used. Movable arm hook 324 provides long arms and a large diameter heavy item to be lifted.

Figure 9:
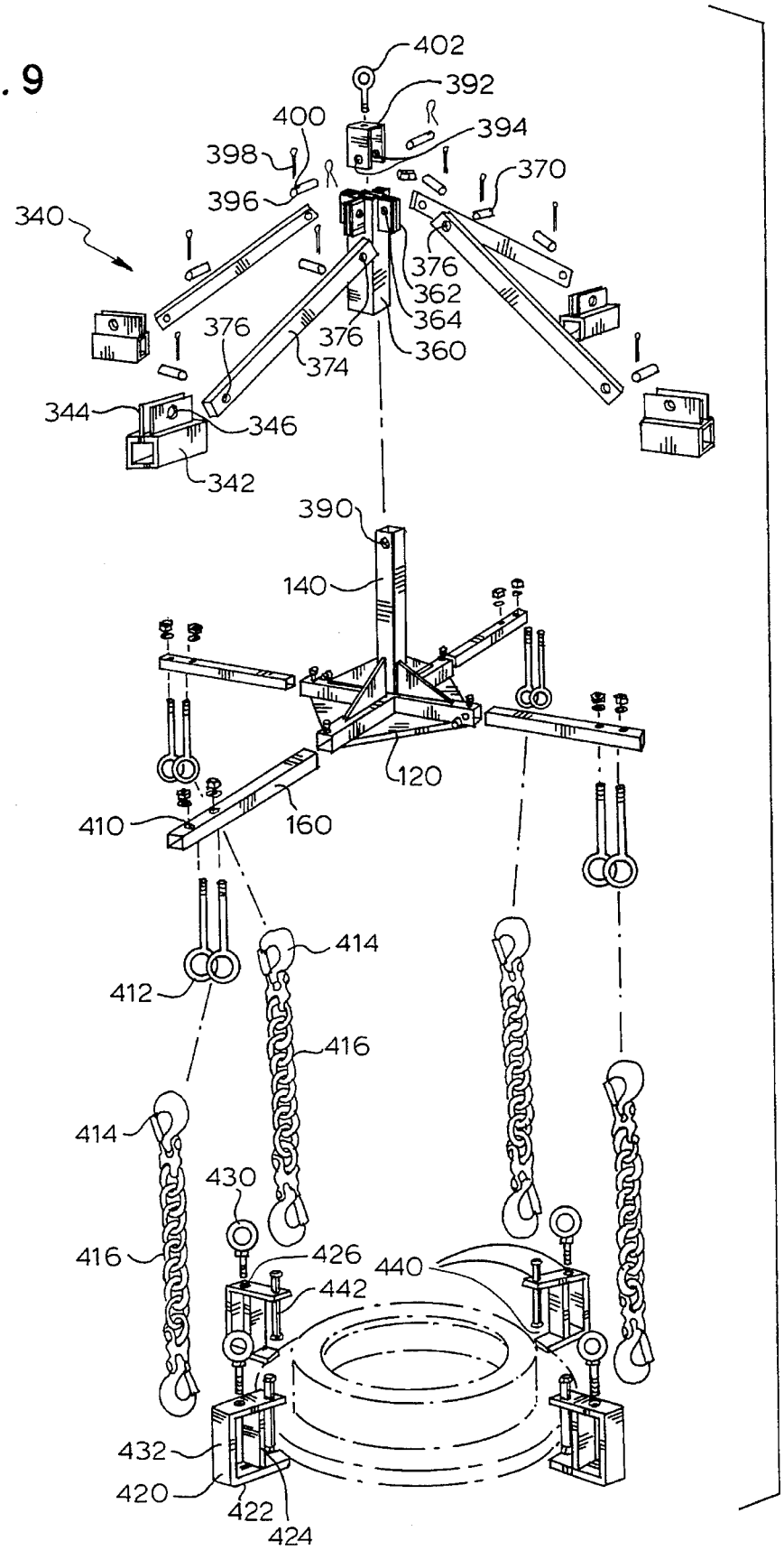
FIG. 9 depicts a top, perspective, exploded view of a modified chain lifting device 340 of this invention.
Figure 10:
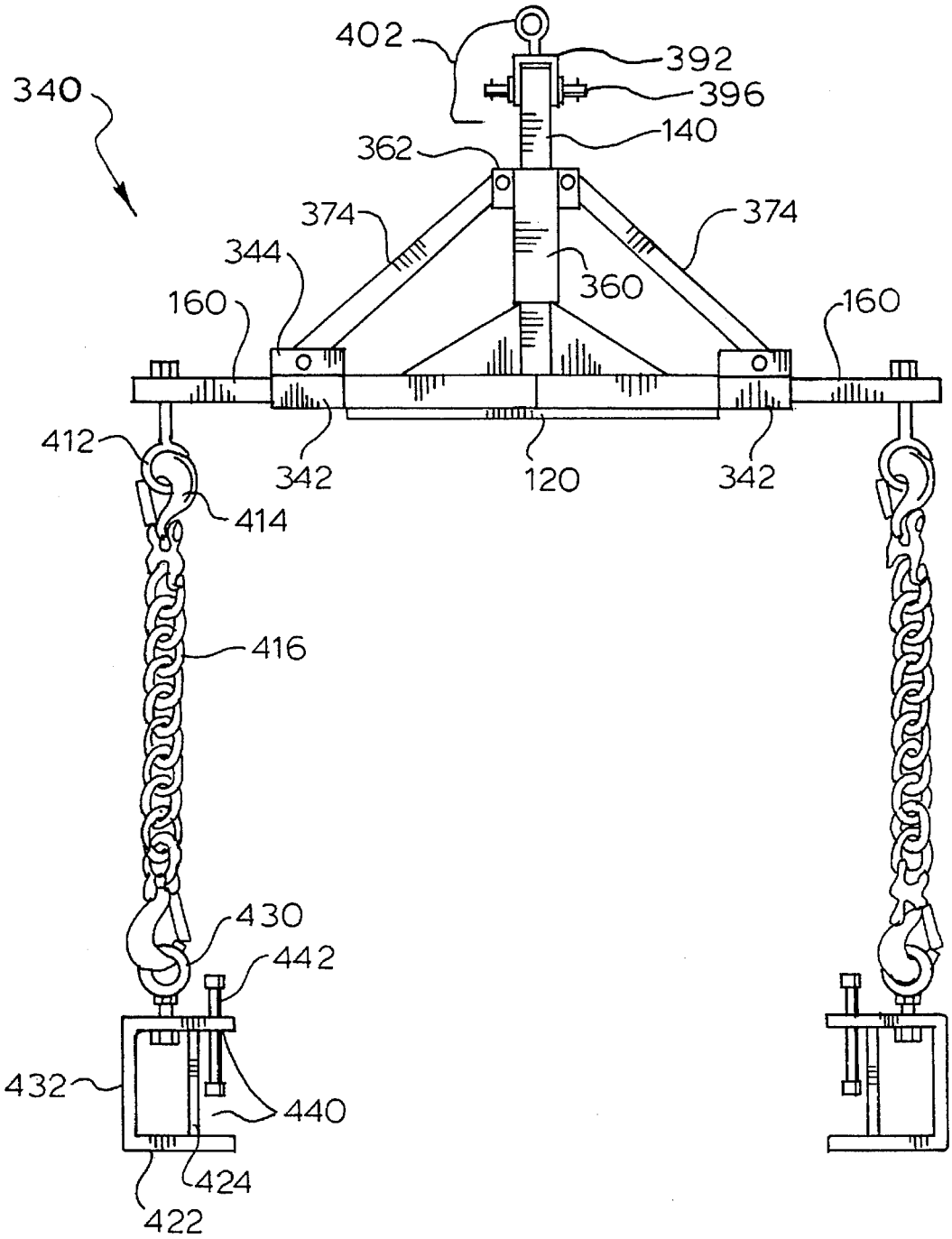
FIG. 10 depicts a front, planar, assembled view of a modified the chain lifting device 340 of this invention.

With FIG. 9 and FIG. 10, a bar buttressing assembly 340 can be shown to strengthen any lifting device of this invention. It is feasible to further strengthen the lifting capability by additionally supporting the adjustable arms 160 with lifting arm 140.

This is accomplished by providing a support sleeve 342 in bar buttressing assembly 340 for each adjustable arm 160. Support sleeve 342 is slidably mounted on each adjustable arm 160. Support sleeve 342 includes a holding flange 344 protruding upwardly from one side thereof. Within the holding flange 344 is at least one flange bolt aperture 346.

Bar buttressing assembly 340 also includes a lifting sleeve 360 to slide over lifting arm 140. Lifting arm sleeve 360 includes four radially spaced lifting arm flanges 362 with at least one lifting arm flange aperture 364 therein to receive a nut and bolt assembly 370. Each lifting arm flange aperture 364 is paired with one flange bolt aperture 346.

A support bar 374 connects each flange bolt aperture 346 with one lifting arm flange aperture 364 thanks to at least one support bar aperture 376 at each end of the support bar 374. The support bar aperture 376 at one end of support bar 374 can be secured to a lifting arm flange aperture 364 while the support bar aperture 376 at the other end of support bar 374 can be secured to a flange bolt aperture 346. In this fashion, any lifting frame of this invention may be greatly strengthened.

Any lifting frame may additionally be buttressed by modifying the lifting arm 140. The lifting arm 140 may have a lifting arm aperture 390 therein. A flat, squared-off, C-shaped member 392 has C-apertures 394 at each end thereof to cooperate with lifting arm aperture 390 and receive a nut and bolt assembly or rod 396 held therein with a cotter pin 398 held by cotter pin aperture 400.

The flat, squared-off, C-shaped member 392 has a top aperture 398 to have an eye assembly 402 bolted therein to provide a grip for any lifting device. With flat, squared-off, C-shaped member 392 removable from the lifting arm 140, it is possible to easily mount bar buttressing assembly 340 on any lifting device.

The eye assembly 398 has a aperture hook receiver 450 extending from top aperture 398 of the C-shaped member 392. O-bolt 452 extends from aperture hook receiver 450 to be received in top aperture 398 and be bolted therein by nut 454 or a similar fastening device.

In order to simplify the attaching of chains and clamps for gripping and lifting sewer frames or the like, it is possible to provide in the lifting arms one or more lifting arm apertures 410. Into these apertures are bolted three elongated eye rings 412. The eye rings 412 may receive therein a clip 414 having a clipped chain 416 secured thereto. The other end of the clipped chain 416 also has a clip 414 for attaching to clamp eye rings 430 of D-clamps 420 to be attached to a sewer frame or the like.

These D-clamps 420 are themselves somewhat C-shaped. The D-clamps 420 include an outer C-housing 422, a support bar 424, and a bar aperture 426 to receive a bolted O-ring member 430. Bar aperture 426 is between the base 432 of the C-housing 422 and support bar 424.

Outside the support bar 424 at one end of C-housing 422 is a clamping aperture 440. The clamping aperture 440 receives a threaded screw 442 capable of contacting the other end of C-housing 422 for clamping D-clamp 420 to the outside of a sewer frame or the like. This structure provides a very simple strong support for the outside frame.

This application—taken as a whole with the specification, claims, abstract, and drawings—provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modification of this method and apparatus can become clear to a person having ordinary skill in this particular art. Such modifications are clearly covered by this disclosure.

What is claimed and sought to be protected by Letters Patent of the United States is:

1. An adjustable lifting device for raising and transporting a heavy item comprising:

a lifting frame;

a first adjustable arm and a second adjustable arm being secured to the lifting frame;

a lifting arm being secured to the lifting frame;

a reinforcing means securing the lifting arm to the lifting frame;

the first adjustable arm and the second adjustable arm each including an adjusting means for removably connecting the lifting device to the heavy item;

the first adjustable arm having a fixed member and a movable member;

the fixed member being secured to the frame;

the movable member having a first arm end oppositely disposed from a second arm end thereof; the first arm end fitting a first type of a heavy item;

the second arm end fitting a second type of a heavy item;

the frame being a flat sheet;

the first adjustable arm being substantially similar in construction to the second adjustable arm;

the adjusting means including an arm securing means for releasably securing the movable member to the fixed member;

the arm securing means providing for fixing and adjusting a length of the first adjustable arm;

the first adjustable arm and the second adjustable arm being in combination with a third adjustable arm and a fourth adjustable arm;

the first adjustable arm being substantially similar in construction to the third adjustable arm and the fourth adjustable arm;

the first adjustable arm, the second adjustable arm, the third adjustable arm and the fourth adjustable arm being substantially equally and radially spaced apart;

the lifting arm being substantially perpendicular to the frame;

the reinforcing means including a first means for connecting the first adjustable arm to the lifting arm;

the reinforcing means including a second means for connecting the second adjustable arm to the lifting arm;

the reinforcing means including a third means for connecting the third adjustable arm to the lifting arm; and the reinforcing means including a fourth means for connecting the fourth adjustable arm to the lifting arm.

2. The adjustable lifting device of claim 1 further comprising:

a) a lifting arm hook being secured to a lifting arm collar;

b) the lifting arm collar including a tubular member capable of receiving the lifting arm and positioning the lifting arm hook for use; and c) a lifting arm stop secured to the lifting arm to support the lifting arm collar at a desired position.

3. The adjustable lifting device of claim 1 the fixed member and the movable member being in a female to male relationship.

4. The adjustable lifting device of claim 1 further comprising:

a) the lifting arm having an arm aperture therein oppositely disposed from the lifting frame;

b) a squared C-shaped member sliding over the arm aperture and having corresponding member apertures in each;

c) a cotter pin assembly holding the lifting arm and the squared C-shaped member joined; and d) an O-ring being secured at a top of the C-shaped member to provide a lifting point for the adjustable lifting device.

5. The adjustable lifting device of claim 1 further comprising:

a) an arm sleeve for each adjustable arm being slidably mounted thereover;

b) a lifting sleeve being slidably mounted over the lifting arm; and c) a connecting means joining each arm sleeve to the lifting sleeve.

6. The adjustable lifting device of claim 1 further comprising the reinforcing means being a flat member in the shape of a right triangle secured to the lifting arm and the frame.

* * * * *